US008215685B2

(12) United States Patent
Ellis

(10) Patent No.: US 8,215,685 B2
(45) Date of Patent: Jul. 10, 2012

(54) DOUBLE DRAW BAR SPRING MECHANISM

(75) Inventor: Philip C. Ellis, Newtown Square, PA (US)

(73) Assignee: Newfrey, LLC, Newark, DE (US)

( * ) Notice: Subject to any disclaimer, the term of this patent is extended or adjusted under 35 U.S.C. 154(b) by 551 days.

(21) Appl. No.: 12/386,460

(22) Filed: Apr. 17, 2009

(65) Prior Publication Data

US 2010/0264672 A1 Oct. 21, 2010

(51) Int. Cl.
*E05B 3/00* (2006.01)
*E05C 1/12* (2006.01)

(52) U.S. Cl. ..... 292/336.3; 292/165; 292/169; 292/347; 292/DIG. 61

(58) Field of Classification Search ..... 292/4, 34, 292/37, 159, 165, 169, 171, 1, 1.5, 137, 169.12, 292/169.15, 169.16, 169.21, 169.22, 169.23, 292/226, 347, 348, DIG. 27, DIG. 61, 336.3
See application file for complete search history.

(56) References Cited

U.S. PATENT DOCUMENTS 1,220 A * 7/1839 Duntze ..... 292/169.21
4,402 A * 3/1846 Kinsley ..... 292/169.21
1,727,054 A * 9/1929 Farnsworth ..... 70/134
1,772,790 A * 8/1930 Weaver ..... 70/150
2,146,700 A * 2/1939 Peterson ..... 292/48
2,250,036 A * 7/1941 Schlage ..... 292/1.5
2,453,505 A * 11/1948 Fornwald ..... 70/283
2,674,448 A * 4/1954 Marple ..... 267/151
2,729,485 A * 1/1956 Schlage ..... 292/1
2,801,869 A * 8/1957 George ..... 292/226
2,865,666 A * 12/1958 Kubik ..... 292/163
2,899,228 A * 8/1959 Polchinski et al. ..... 292/169.18
3,027,188 A * 3/1962 Eichstadt ..... 296/51
3,097,872 A * 7/1963 Russell ..... 292/169.17
3,120,972 A * 2/1964 Remke et al. ..... 292/169.22
3,212,806 A * 10/1965 Russell et al. ..... 292/336.3
3,590,610 A * 7/1971 Hayakawa ..... 70/92
3,708,191 A * 1/1973 Hegedus ..... 292/1
3,768,086 A * 10/1973 Powell et al. ..... 340/546
3,979,931 A * 9/1976 Man ..... 70/38 A
4,106,316 A * 8/1978 Tippin ..... 70/268
4,126,340 A * 11/1978 Pelcin ..... 292/1
4,216,985 A * 8/1980 Sorensen ..... 292/336.3
4,227,723 A * 10/1980 Rosell ..... 292/34
4,290,280 A * 9/1981 Yun ..... 70/38 A
(Continued)

*Primary Examiner* — Thomas Beach
*Assistant Examiner* — Alyson M Merlino
(74) *Attorney, Agent, or Firm* — Ober, Kaler, Grimes & Shriver; Royal W. Craig; Christopher F. Lonegro

(57) ABSTRACT

A double slide arm spring mechanism for biasing a primary mechanism to home position after operation and retaining the primary mechanism in the home position pending further operation. The double slide arm spring mechanism includes a pair of slideably interlocking arms each having a longitudinal frame member and a spring engaging flange at each end. The frame members are a disposed to engage one another while permitting relative sliding of the arms. The slide arms are interlocked such that one flange of each arm is situated between the two flanges of the other arm. Two compression springs are retained between the flanges of the arms such that sliding of either arm toward the other necessarily compresses both springs. Potential energy stored in the springs returns the slide to its neutral position when the operator is released thereby also returning the operator to its neutral position. The slide arms produce twice as much force to return operator to it neutral position as would be possible using springs of the same length operated independently.

19 Claims, 7 Drawing Sheets

U.S. PATENT DOCUMENTS 4,296,956 A * 10/1981 Colombo ..... 292/169.18
4,395,063 A * 7/1983 Bianco ..... 292/150
4,552,393 A 11/1985 Wartian
4,736,970 A 4/1988 McGourty et al.
4,784,417 A * 11/1988 Fleming et al. ..... 292/347
4,871,202 A * 10/1989 Friedrichs et al. ..... 292/169
4,899,562 A * 2/1990 Gartner et al. ..... 70/277
4,911,489 A * 3/1990 Hansen et al. ..... 292/336.3
4,925,222 A * 5/1990 Loock ..... 292/336.3
4,974,884 A * 12/1990 Dietrich ..... 292/173
4,982,986 A 1/1991 Gressett, Jr. et al.
4,998,760 A * 3/1991 Nixon et al. ..... 292/347
5,004,278 A 4/1991 Kang et al.
5,076,015 A * 12/1991 Manzalini ..... 49/192
5,092,144 A * 3/1992 Fleming et al. ..... 70/95
5,169,184 A * 12/1992 Bishop ..... 292/1.5
5,301,525 A * 4/1994 Doring ..... 70/107
5,373,716 A * 12/1994 MacNeil et al. ..... 70/109
5,484,177 A * 1/1996 Fortune et al. ..... 292/140
5,640,863 A 6/1997 Frolov
5,718,468 A 2/1998 Qureshi et al.
5,813,261 A * 9/1998 Boehlow ..... 70/379 R
5,987,945 A * 11/1999 Ruano Aramburu ..... 70/277
6,286,347 B1 9/2001 Frolov
6,471,258 B1 * 10/2002 Bombuy Perich ..... 292/165
6,491,327 B1 * 12/2002 Fan ..... 292/165
6,543,264 B2 * 4/2003 Frolov ..... 70/222
6,581,423 B2 * 6/2003 Lin ..... 70/107
6,612,627 B2 * 9/2003 Wheatland ..... 292/169
6,619,705 B2 * 9/2003 Dalsing ..... 292/169.14
6,651,468 B2 * 11/2003 Aramburu et al. ..... 70/222
6,662,603 B2 * 12/2003 Morris ..... 70/107
6,669,243 B2 * 12/2003 Katoh et al. ..... 292/34
6,880,872 B2 4/2005 Eller et al.
6,921,116 B2 * 7/2005 Humes ..... 292/169
6,926,319 B2 * 8/2005 Bates et al. ..... 292/359
7,204,527 B2 * 4/2007 Geurden ..... 292/122
RE40,193 E * 4/2008 Boehlow ..... 70/379 R
7,389,661 B2 * 6/2008 Viviano et al. ..... 70/379 R
7,695,028 B2 * 4/2010 Katou et al. ..... 292/34
7,900,978 B2 * 3/2011 Zimmer ..... 292/100
8,001,813 B1 * 8/2011 Turnbo ..... 70/129
2002/0117865 A1 * 8/2002 Sub ..... 292/336.3
2003/0126896 A1 * 7/2003 Mori ..... 70/214
2004/0135377 A1 * 7/2004 Humes ..... 292/169
2006/0125248 A1 * 6/2006 Heeley et al. ..... 292/336.3
2010/0264672 A1 * 10/2010 Ellis ..... 292/87

* cited by examiner

DOUBLE DRAW BAR SPRING MECHANISM

BRIEF DESCRIPTION OF THE DRAWINGS

The objects, features, and advantages of the present invention will become apparent from the following detailed description of the preferred embodiments and certain modifications thereof when taken together with the accompanying drawings in which like numbers represent like items throughout and in which.

DETAILED DESCRIPTION OF THE PREFERRED EMBODIMENT

Figure 1:
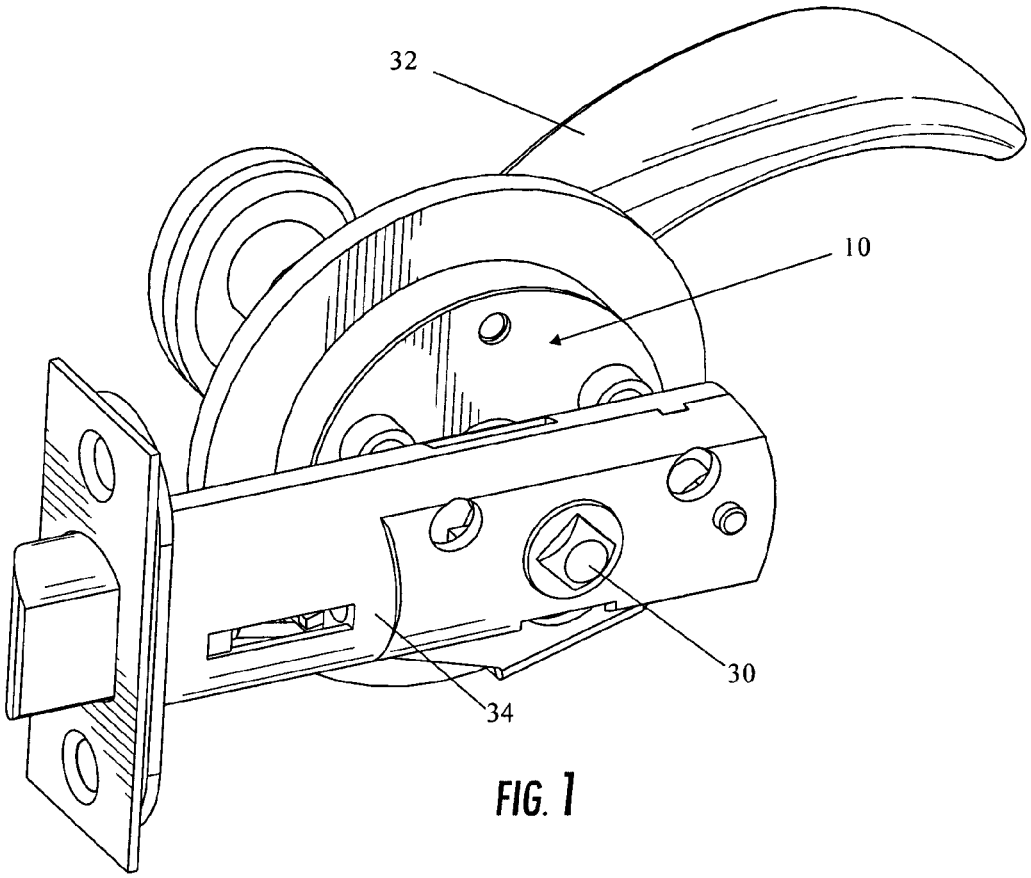
FIG. 1 is a perspective view of the fully assembled power pack in conjunction with a door lever, spindle and tubular latch.

For the purposes of promoting an understanding of the principles of the invention, reference will now be made to the exemplary embodiment illustrated in the drawings and described below. The embodiment disclosed is not intended to be exhaustive or limit the invention to the precise form disclosed in the following detailed description. Rather, the embodiment is chosen and described so that others skilled in the art may utilize its teachings. It will be understood that no limitation of the scope of the invention is thereby intended. The invention includes any alterations and modifications in the illustrated device, the methods of operation, and further applications of the principles of the invention which would normally occur to one skilled in the art to which the invention relates.

The invention is a power pack assembly for biasing a primary door opening mechanism to a neutral or home position after being manually displaced from the home position, and for retaining the primary mechanism in that home position despite ambient forces (such as the force of gravity acting on the door lever), until such time as additional manual force is applied to again operate it. Displacement of the primary mechanism may be rotational or angular displacement about an axis, or linear displacement. As depicted in FIG. 1, the invention is described herein in the context of a door handle set, with a latch being the primary mechanism, such that angular rotation of a spindle 30 in response to operation of a door lever 32 to retract the bolt of tubular latch 34 is contemplated. The power pack assembly 10 according to the present invention is low-profile, may be countersunk into the door, and serves to return the door lever 32 (or a door knob) to a generally horizontal home position after the latch has been operated and assists in returning the bolt to the extended position.

Figure 2:
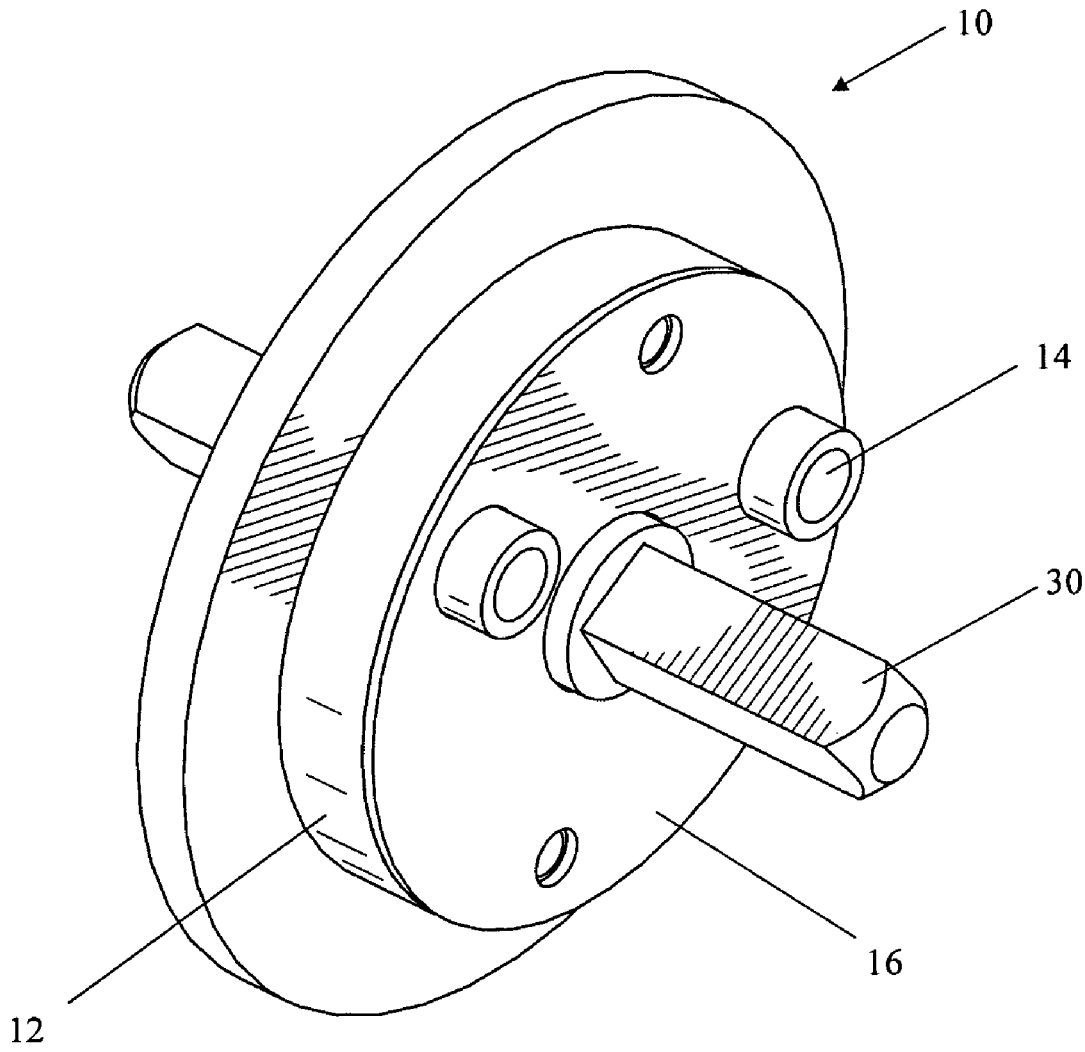
FIG. 2 is a perspective view of the power pack assembly in conjunction with a spindle.

FIG. 2 depicts the power pack assembly 10 isolated from the door lever 32 and latch 34 but with spindle 30 in place. A housing 12 is provided. Housing 12 is preferably circular in form having a diameter of less than 2⅛ inch so as to be partially recessed within the standard size holes provided within commercial doors for installation of the handle set. Housing 12 may be integrally formed with a decorative rose plate for flush seating on the surface of the door around the handle set knob or lever 32. A plurality of holes 14 may be provided through the housing 12 for securing the housing directly to the door, or as illustrated through-bolting through the tubular latch 34 to a cooperative rose plate on the opposite side of the door. The housing 12 includes a removable cover plate 16 for easy assembly and servicing of the power pack 10.

Figure 3:
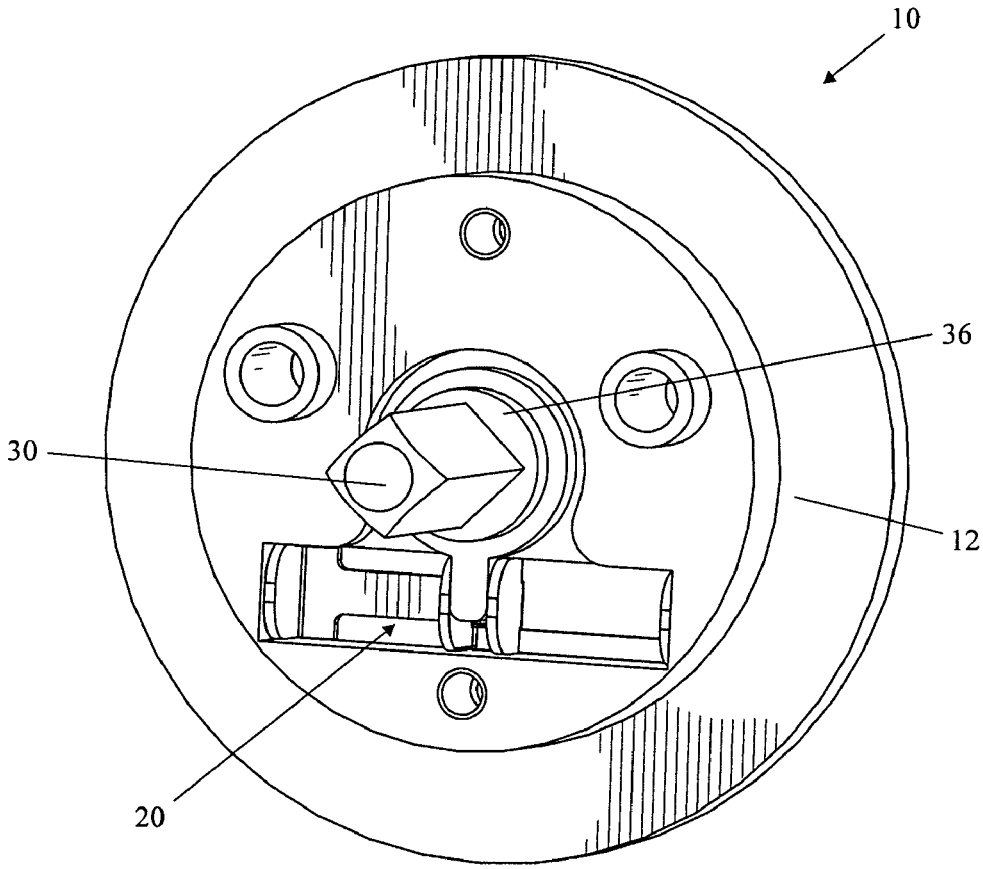
FIG. 3 is perspective view of the power pack in conjunction with a spindle and with the cover plate removed and the springs omitted.
Figure 4:
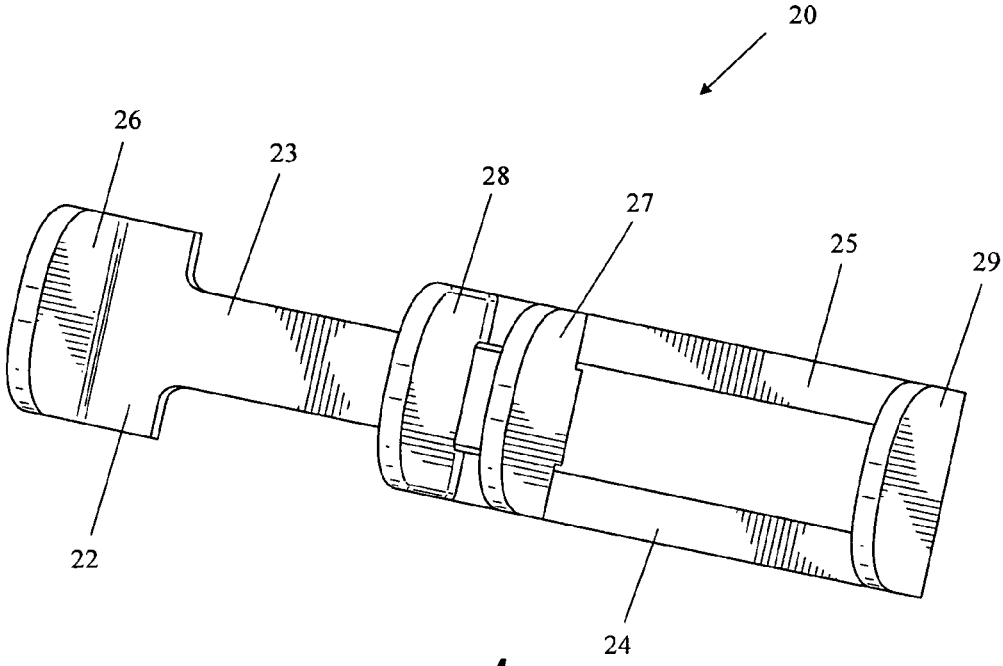
FIG. 4 is an isolated perspective view of the slide arms with the springs and other elements omitted.

With the cover plate 16 removed, as depicted in FIG. 3, slide arms 20 are visible, slideably retained within the housing 12. The compression springs (described below) have been omitted for clarity in this view. With further reference to FIG. 4, the slide arms 20 include a first arm 22 and a second arm 24 slideably interlocked together. Arms 22, 24 each have a primary longitudinal frame member 23, 25, respectively. Frame members 23, 25 are a disposed to engage one another while permitting relative sliding of the arms 22, 24 along their longitudinal axes. As depicted, one frame member 23 is provided in the form of a narrow central rail running between orthogonal flanges 26, 27 at either end. The other frame member 25 is depicted as a spaced pair of upper and lower rails running between orthogonal flanges 28, 29 at either end. The upper and lower rails of frame member 25 are spaced to receive the central rail of frame member 23. Flange 27 is truncated where it joins frame member 23 to provide clearance to allow the upper and lower rails of frame member 25 to pass.

Flanges 26, 27, 28, 29 anchor compression springs (not shown in this view), and for this purpose may be generally orthogonal tabs projecting from their respective frame members. However, the flanges 26, 27, 28, 29 may take other forms including protrusions, hooks, pins or any other means for retaining a spring including tack welds of the spring ends directly to the respective frame members. As stated, first and second arms 22, 24 are interlocked such that flange 28 is situated between flanges 26 and 27. Similarly, flange 27 is situated between flanges 28 and 29, as best seen in FIG. 4. It should be observed that first and second arms 22, 24 need not be directly interlocked with one another as depicted herein but rather may be engaged by being separately slideably retained within, for example, a housing such that that their flanges 26, 27, 28, 29 are interposed as described above. First and second arms 22, 24 are, in such an embodiment, mechanically linked by the compression springs alone, as described below.

Figure 6:
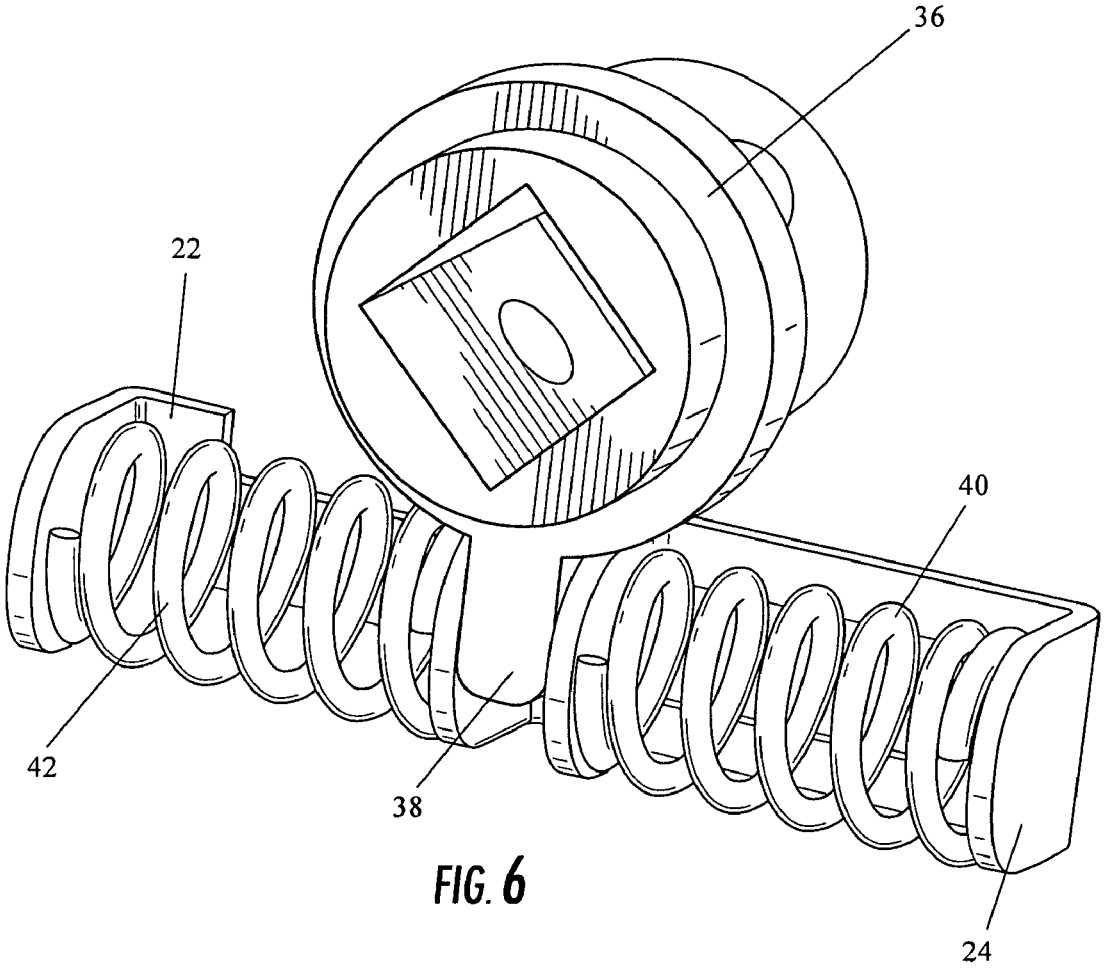
FIG. 6 is an isolated perspective view of the slide arms with the springs and spindle hub included.

FIG. 6 illustrates two compression springs 42, 40 mounted in the slide arms 20 between the flanges 26, 27, 28, 29. A first compression spring 42 is thus retained between flange 26 and flange 28, while a second compression spring 40 is retained between flange 27 and flange 29, the first and second arms 22, 24 being mechanically linked and biased apart by compression springs 40, 42.

Figure 5:
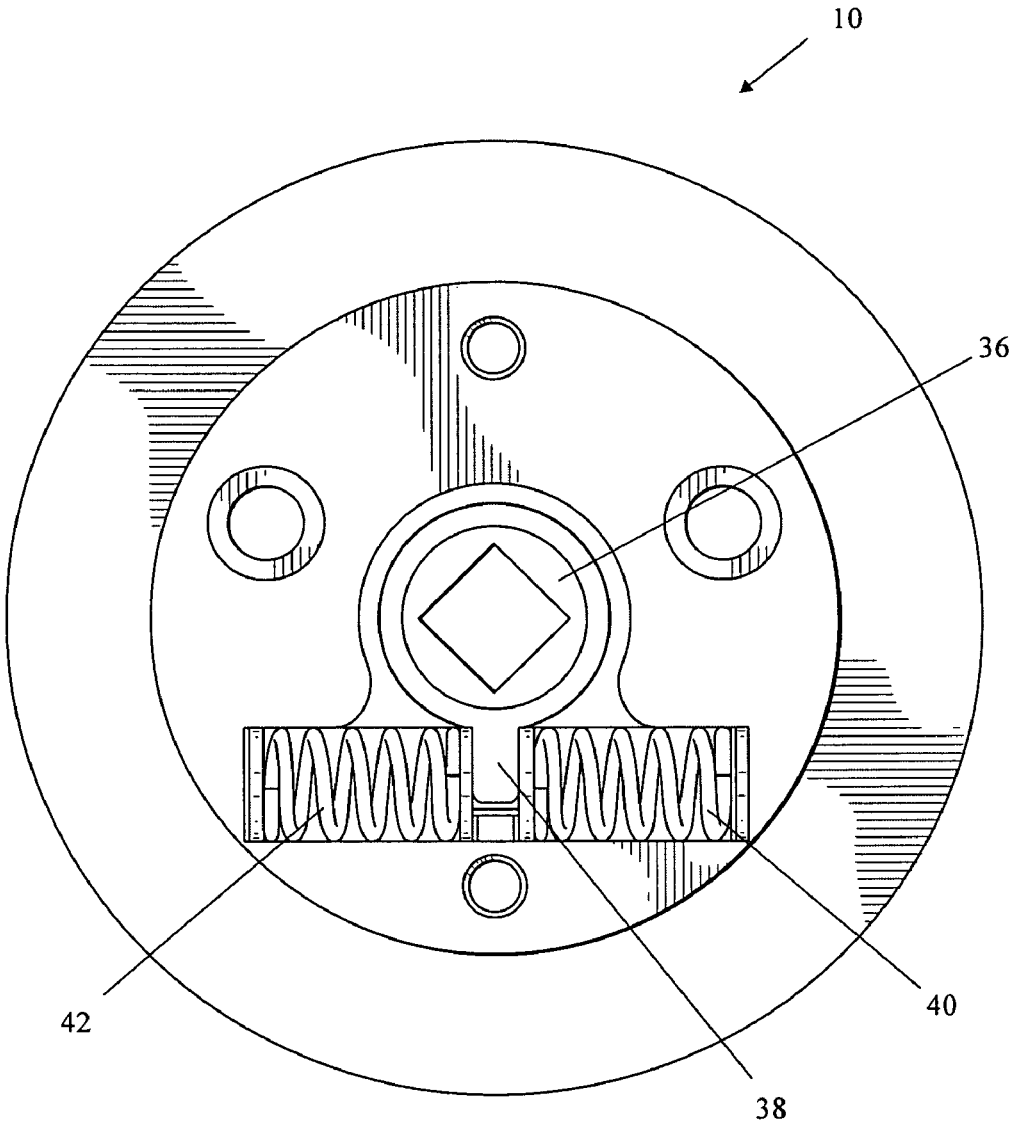
FIG. 5 is a front view of the power pack with the cover plate removed and the springs inserted.

With reference to FIGS. 3 and 5, a spindle hub 36 is rotatably mounted within housing 12. Spindle hub 36 receives the keyed spindle 30 mechanically linking the power pack 10 with door lever 32. The spindle 30 is keyed to the spindle hub 36, generally having a non-round cross-section (for example, square as shown), and spindle hub 36 is cooperatively shaped to receive and rotate with the spindle 30. Spindle hub 36 is further provided with a cam 38 extending radially from the spindle 30 to engage the slide arms 20. Specifically, as best seen in FIG. 6, cam 38 extends between the two center flanges 27, 28. This way, as door lever 32 is rotated the spindle hub 36 is rotated in the same direction via the spindle 30 thereby rotating and laterally displacing the cam 38. Cam 38 is sized to provide the necessary lateral displacement of the cam to engage the slide arms 20. The greater the maximum length of the cam 38 from the rotational center of the hub the greater the lateral displacement cam 36 and slide arms 20 and thus the greater the compression of the springs 40, 42, as further described below.

Figure 7:
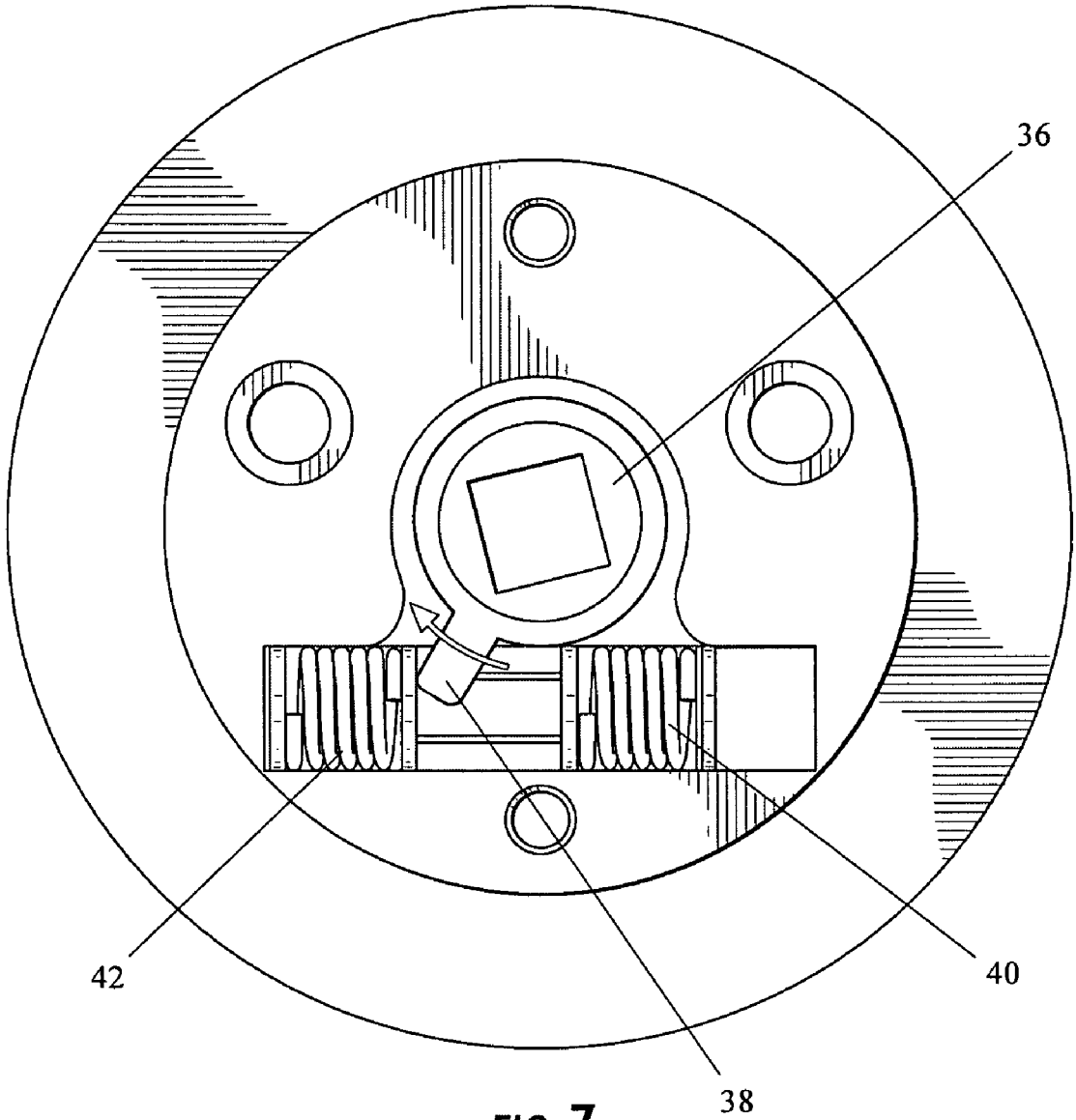
FIG. 7 is a front view of the power pack with the cover plate removed in a displaced condition.

Counterclockwise rotation of cam 38 engages the first slide arm 22 at flange 27, and clockwise rotation of cam 38 engages the second slide arm 24 at flange 28. Thus, as depicted in FIG. 7, clockwise rotation of the spindle hub 36 forces flange 28 to slide into and compress first spring 42 between itself and flange 26, flange 26 being held in place by the housing 12. At the same time, sliding of flange 28 draws flange 29 in the same directing via frame member 25, thereby simultaneously compressing second spring 40 between flange 29 and flange 27, flange 27 being held in place via frame member 23 and flange 26 contacting the housing 12. The compression of first and second springs 42, 40 creates potential energy, and springs 42, 40 return-bias second arm 24 to the home position when the door lever 32 is released thereby forcing the lever 32, via the hub 36 and spindle 30, back to its neutral horizontal position and retaining it in that position indefinitely.

Rotation of the spindle hub 36 in the opposite direction produces a like result, with cam 38 forcing flange 27 to slide into and compress second spring 40 between itself and flange 29, which is held in place by the housing 12. At the same time, sliding of flange 27 draws flange 26 in the same directing via frame member 23, thereby simultaneously compressing first spring 42 between flange 26 and flange 28, flange 28 being held in place via frame member 25 and flange 29 contacting the housing. Potential energy again stored in first and second springs 42, 40 likewise returns and maintains first arm 22 and thus door lever 32 in the home position when the door lever 32 is released.

One skilled in the art will now see that the foregoing configuration provides compression of both compression springs 40, 42 regardless of which direction the spindle 30 is rotated thereby providing maximum reverse bias return the spindle 30 and any knob or lever connected thereto to the rest position. This produces twice as much force as would be possible using independent springs of the same length, and entirely eliminates the need for more expensive and less reliable expansion springs or torsion springs yet applies the entire righting force of both springs in compression only leading to more both reliable operation and less expensive manufacture. The forgoing design further simplifies the mechanisms of the prior art, reducing the total number of parts thereby providing smoother operation and reduced wear cost.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims and may be used with a variety of materials and components. This application is therefore intended to cover any variations, uses, or adaptations of the invention using its general principles. Further, this application is intended to cover such departures from the present disclosure as come within known or customary practice in the art to which this invention pertains.

I claim:

1. A biasing apparatus for returning a rotatably-mounted member having a single radially protruding operator to a neutral position, said apparatus comprising: a slide arm assembly receiving the radially protruding operator, said slide arm assembly comprising: a first arm having a first protruding end and second protruding end, and a second arm having a first protruding end and second protruding end, said first arm and second arm being cooperatively interlocked such that said first protruding end of said second arm is slideably captive between the first and second protruding ends of said first arm and the second protruding end of said first arm is slideably captive between said first and second protruding ends of said second arm, said slide arm assembly receiving said radially protruding operator between said second protruding end of said first arm and said first protruding end of said second arm; a first spring engaged between said first protruding end of said first arm and said first protruding end of said second arm; a second spring engaged between said second protruding end of said first arm and said second protruding end of said second arm; wherein by rotation of said rotatably-mounted member in a first direction, said radially protruding operator is engaged only with said first protruding end of said second arm causing said second arm to slide relative to the first arm that is held stationary, thereby simultaneously compressing said first and second springs and by rotation of said rotatably-mounted member in a second direction, said radially protruding operator is engaged only with said second protruding end of said first arm causing said first arm to slide relative to the second arm that is held stationary, thereby simultaneously compressing said first and second springs.

2. The biasing apparatus of claim 1 wherein said operator protrudes orthogonally from said rotatably-mounted member.

3. The biasing apparatus of claim 2 wherein the first and second protruding ends each include a spring engaging flange.

4. The biasing apparatus of claim 3 wherein said operator is disposed between the spring engaging flange at the second end of said first arm and said spring engaging flange at the second end of said second arm for alternate engagement thereof.

5. The biasing apparatus of claim 1 further comprising a housing, said slide arms being slideably retained in said housing.

6. The biasing apparatus of claim 1 wherein said operator extends radially from a spindle hub coupled to the rotatably-mounted member for rotation therewith.

7. The biasing apparatus of claim 6 wherein said rotatably-mounted member comprises one of a door knob or lever attached to a spindle, said spindle being engaged in said spindle hub.

8. The biasing apparatus of claim 1 wherein said first spring and said second spring are compression springs.

9. The biasing apparatus of claim 4 wherein said spring engaging flanges form a substantially 90 degree angle with said first and second arms.

10. A power pack assembly for returning a door operator to a neutral position comprising: a housing; a first slide arm slideably retained in a first home position in said housing, said first slide arm having a first end and second end, and a second slide arm slideably retained in a second home position in said housing, said second slide arm having a first end and second end, said slide arms each having a spring engaging flange at each end, said slide arms being slideably interlocked together such that said first end of said second slide arm is slideably captive between the first and second ends of said first slide arm and the second end of said first slide arm is slideably captive between said first and second ends of said second slide arm; a first spring engaged between the spring engaging flange of said first end of said first slide arm and the spring engaging flange of said first end of said second slide arm; a second spring engaged between the spring engaging flange of said second end of said first slide arm and the spring engaging flange of said second end of said second slide arm; a hub rotatably mounted in said housing for receiving a spindle of said door operator, said hub further comprising a single cam projecting radially therefrom, said single cam disposed between said spring engaging flange of said second end of said first slide arm and said spring engaging flange of said first end of said second slide arm wherein said door operator is biased to return to said neutral position after rotation of said door operator in a first direction by engagement of said cam with only said second slide arm and is biased to return to said neutral position after rotation of said door operator in a second direction by engagement of said cam with only said first slide arm, said second slide arm being displaced from said second home position by rotation of said cam in said first direction to thereby simultaneously compress said first and second springs and said first slide arm being displaced from said first home position by rotation of said cam in said second direction to thereby simultaneously compress said first and second springs.

11. The power pack assembly of claim 10 wherein said door operator is a knob or lever.

12. The power pack assembly of claim 10 wherein said housing is circular in cross section.

13. The power pack assembly of claim 12 wherein said housing is disposed for mounting to the face of a door.

14. The power pack assembly of claim 13 wherein said housing is mounted by through-bolting to a cooperative plate on an opposite side of said door.

15. The power pack assembly of claim 12 wherein said housing is less than 2⅛ inch in diameter.

16. A mechanism for returning a door knob or lever to a neutral position after turning and releasing of said door knob or lever, comprising a double slide arm mechanism including a first slide arm and a second slide arm, said first and second slide arms being slidably engaged together for relative extension and retraction, a first compression spring biasing one protruding end of said first slide arm against one protruding end of said second slide arm, a second compression spring biasing another protruding end of said first slide arm against another protruding end of said second slide arm, and a hub extending a single cam to engage only said first slide arm when said hub is rotated in one direction and to engage only said second slide arm when rotated in another direction.

17. A method of biasing a rotatable member to a home position comprising the steps of: providing a pair of slide arms, said slide arms comprising a first and second slide arm each having a first protruding enc and a second protruding end; slideably mounting said slide arms within a housing such that said first protruding end of said second slide arm is interposed between said first and second protruding ends of said first slide arm and said second protruding end of said first slide arm is interposed between said first and second protruding ends of said second slide arm, each slide arm being constrained within a range of sliding movement back and forth to/from an initial position; connecting a first compression spring to said first protruding end of said first slide arm and said first protruding end of said second slide arm; connecting a second compression spring to said second protruding end of said first slide arm and said second protruding end of said second slide arm; providing a single operator for alternately engaging only one of said slide arms when said rotatable member is rotated clockwise from a home position, and engaging only the other of said slide arms when said rotatable member is rotated counter-clockwise from said home position, in both instances simultaneously compressing said first and second compression springs and generating a return bias for returning said rotatable member to said home position.

18. The method of biasing a mechanism to a home position of claim 17 wherein said rotatable member comprises one of a door knob or door lever.

19. The method of biasing a door knob or lever to a home position of claim 17 wherein said operator is a cam for contacting said slide arms; said operator located on a spindle hub coupled to the rotatable member.

* * * * *